US005157213A

United States Patent [19]

Kashio et al.

[11] Patent Number: 5,157,213

[45] Date of Patent: Oct. 20, 1992

[54] PORTABLE ELECTRONIC APPARATUS

[75] Inventors: Yukio Kashio, Tokyo; Yoneaki Arai, Hanno, both of Japan

[73] Assignee: Casio Computer Co., Ltd., Tokyo, Japan

[21] Appl. No.: 606,116

[22] Filed: Oct. 31, 1990

Related U.S. Application Data

[60] Division of Ser. No. 401,526, Aug. 29, 1989, Pat. No. 4,995,294, which is a continuation of Ser. No. 53,384, May 22, 1987, abandoned.

[30] Foreign Application Priority Data

| | | | |
|---|---|---|---|
| May 26, 1986 | [JP] | Japan | 61-120724 |
| Jun. 30, 1986 | [JP] | Japan | 98967[U] |
| Jul. 9, 1986 | [JP] | Japan | 104238[U] |
| Sep. 10, 1986 | [JP] | Japan | 138883[U] |

[51] Int. Cl.[5] ..... G10H 7/00

[52] U.S. Cl. ..... 84/622; 84/626; 84/644; 84/658; 84/723; 84/735; 84/DIG. 7

[58] Field of Search ..... 84/DIG. 7, DIG. 12, 84/422.1–422.4, 735, 737, 738, 744, 738, 744, 626, 644, 622, 627, 659, 653, 658, 687, 692, 718; 200/61.45 R, 61.46, 61.47, 61.51, 61.52, 61.48

[56] References Cited

U.S. PATENT DOCUMENTS

| | | | |
|---|---|---|---|
| 3,053,949 | 9/1962 | Johnson . | |
| 3,669,409 | 6/1972 | Eranosian . | |
| 3,731,022 | 5/1973 | Loftus . | |
| 4,341,140 | 7/1982 | Ishida . | |
| 4,581,507 | 4/1986 | Bai . | |
| 4,776,253 | 10/1988 | Downes . | |
| 4,904,222 | 2/1990 | Gastgeb et al. | 84/422.4 X |
| 4,909,117 | 3/1990 | Reiling et al. . | |
| 4,911,053 | 3/1990 | Kashio et al. | 84/725 |
| 4,998,457 | 3/1991 | Suzuki et al. | 84/644 X |
| 5,062,341 | 11/1991 | Reiling et al. | 84/702 |

FOREIGN PATENT DOCUMENTS

| | | |
|---|---|---|
| 59-5912 | 2/1984 | Japan . |
| 2183076 | 5/1987 | United Kingdom . |
| 2208027 | 2/1989 | United Kingdom . |

OTHER PUBLICATIONS

Playtime's Rhythm Rods catalog (1990).
Nasta's Hit Stix catalog (1989).

*Primary Examiner*—A. T. Grimley
*Assistant Examiner*—Matthew S. Smith
*Attorney, Agent, or Firm*—Frishauf, Holtz, Goodman & Woodward

[57] ABSTRACT

A striker designed to strike or be swung for playing music is provided with a musical sound-initiating command signal-generating device including switching members. When the striker strikes or swings, the switching members perform a switching action which triggers the transmitting of a musical sound-initiating command signal from the musical sound-initiating command signal-generating device. A desired musical sound is produced by a musical sound producing unit in response to the musical sound-initiating command signal. A number of different timbres can be selectively used for a musical tone, by operating a timbre-selecting switch provided on the striker.

15 Claims, 13 Drawing Sheets

PORTABLE ELECTRONIC APPARATUS

This is a division of application Ser. No. 07/401,526 filed Aug. 29, 1989, now U.S. Pat. No. 4,995,294, which is a continuation of parent application Ser. No. 07/053,384 filed May 22, 1987, now abandoned.

BACKGROUND OF THE INVENTION

The present invention relates to an electronic percussion instrument of the type in which a desired musical sound is produced by striking or swinging a stick-shaped striker or a drumstick against a drum or the like.

An electronic percussion instrument of this type is already known from the Japanese Utility Model Application Publication No. 5912/59. In this known electronic percussion instrument, a number of piezoelectric elements are embedded in the tip of each of the associated drumsticks used with the instrument, to convert a drumstick's vibrations, caused by striking it against a drum or the like, into electric signals, so that the musical sound which corresponds to a drumstick vibrating will be emitted from one or multiple loudspeakers.

The aforementioned known electronic percussion instrument is, however, accompanied with certain drawbacks. One of the drawbacks lies in the fact that an instrument which uses piezo-electric elements to generate the electric signals necessary for producing desired musical sounds, is quite expensive. Not only are such piezo-electric elements relatively expensive, they are also prone to degradation with time, consequently prohibiting the generation of electric signals of a required level and, therefore, the production of desired musical sounds, after a long perid of use. Another drawback of the known electronic percussion instrument is that since electric signals are detected and desired musical sounds are produced only when the drumstick strikes where piezo-electric elements are embedded, variegated playing performances, for example using the tail of the drumsticks or swinging them, cannot be achieved.

The drumstick of the above-described known electronic percussion instrument is provided with a plurality of piezo-electric elements having different stress sensitivities and frequency characteristics, in order that a musical sound can be generated selectively with a number of different timbres. With this known electronic percussion instrument, however, since different timbres of a musical note are produced by providing a corresponding number of piezo-electric elements having different stress sensitivities and frequency characteristics, the number of different timbres is, nevertheless, limited by the number of the piezo-electric elements which can be incorporated in the drumstick, and thus, a wide variety of timbres beyond that limit cannot be obtained for a given musical note. While it is conceivable for someone skilled in the art to produce an electronic percussion instrument in which a striking or swinging action of a striker or drumstick triggers a switching action of a musical sound-initiating command signal generator, which in turn generates a predetermined musical soundinitiating command signal, a striking or oscillating action by a striker of such a percussion instrument may, however, be accompanied by chattering which may produce undesired musical sounds in the musical sound generating unit. Therefore, preventive measures against such chattering should be provided for this type of electronic percussion instrument.

SUMMARY OF THE INVENTION

It is therefore an object of the present invention to provide an electronic percussion instrument which has a relatively simple construction and can be manufactured at a low cost, but which ensures the generating of correct electric signals and of desired musical sounds without degradation, even after a long period of use, and also permits variegated playing performances.

It is another object of the present invention to provide an electronic percussion instrument which can selectively generate a variety of different timbres for a given musical note, by means of simple switching operations which can be performed without interfering with a player's music playing activities, when a striking or swinging of the striker is being performed by the player.

It is a further object of the present invention to provide an electronic percussion instrument which, even if chattering are produced in the course of striking or swinging a striker, can prevent the production of undesired musical sounds arising from such chattering.

These objects of the present invention are achieved by providing an electronic percussion instrument comprising a pair of stick-shaped strikers which are operated in a striking or swinging manner, a musical sound-initiating command signal generator having a switching system incorporated in the stick-shaped strikers, this switching system performing a switching action when the strikers are operated either in a striking manner or in a swinging manner, to generate musical sound-initiating command signals in accordance with the switching action, and a musical sound producing unit which produces desired musical sounds in accordance with the musical sound-initiating command signals transmitted from the musical sound-initiating command signal generator.

The objects of the present invention are also achieved by providing an electronic percussion instrument comprising a pair of stick-shaped strikers, a musical sound-initiating command signal generator, a musical sound producing unit, and a signal transmitter for transmitting the signals generated by the musical sound-initiating command signal generator when the strikers are made to strike or are swing against the musical sound producing unit.

In addition, the objects of the present invention are achieved by providing an electronic percussion instrument comprising a pair of strikers, a musical sound-initiating command signal generator, a musical sound producing unit, and a timbre selection unit for selecting the timbre of the musical sound to be produced by the musical sound producing unit, in accordance with the musical sound-initiating command signals transmitted from the musical sound-initiating command signal generator, when the strikers are striking or swinging.

DETAILED DESCRIPTION OF THE PREFERRED EMBODIMENT

Figure 1:
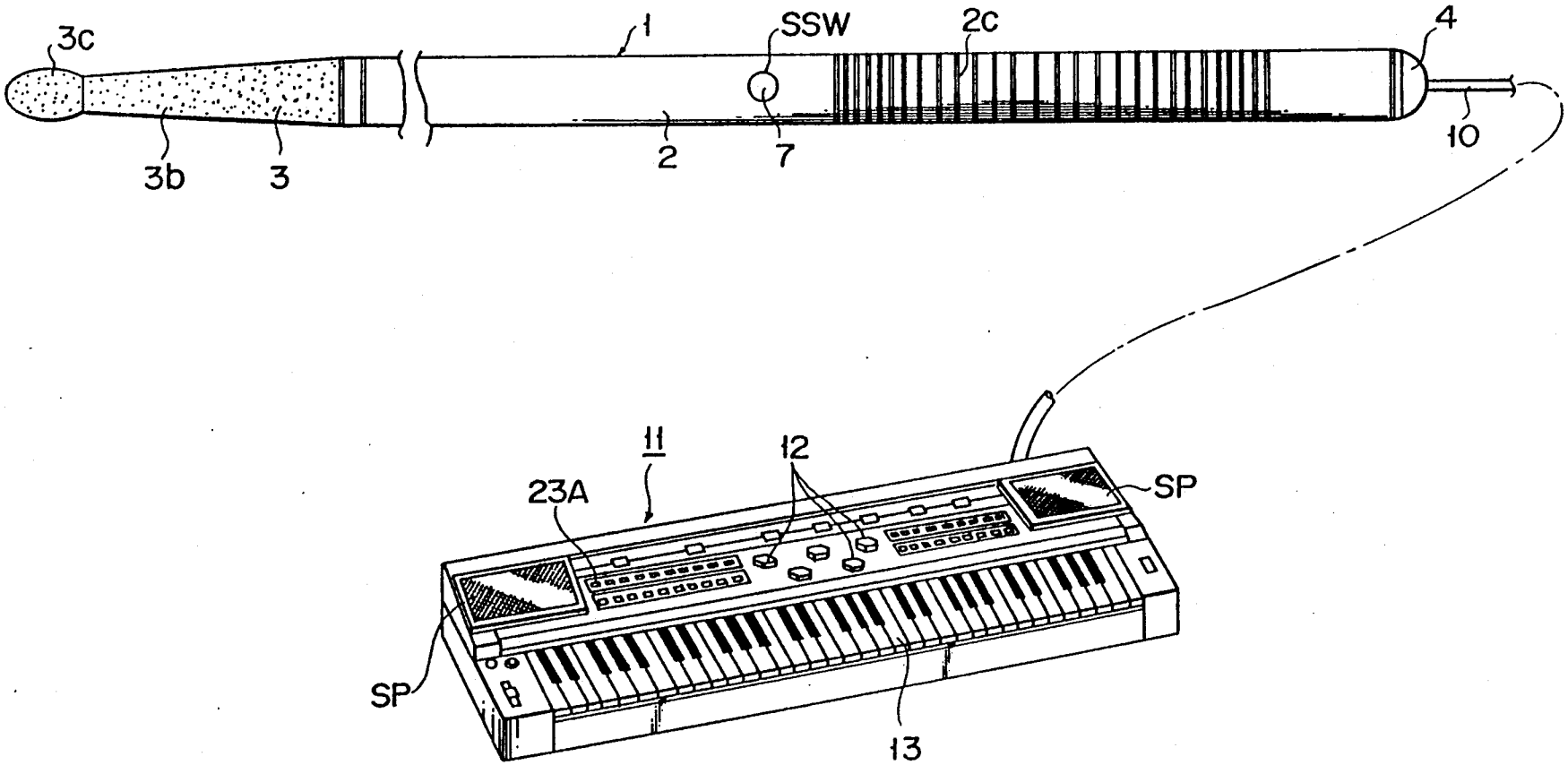
FIG. 1 shows a perspective view of an embodiment of the electronic percussion instrument according to the present invention.

In FIG. 1, which is a perspective view of the first embodiment of the present invention, the striker is illustrated in a disproportionally large scale as compared with that of the musical sound generating unit. As is shown in FIG. 1, striker 1, which is made to strike or swing to produce sound during a musical performance, has a size, appearance, and shape similar to a conventional drumstick.

Striker 1 comprises an elongated cylindrical stick-shaped body 2, a head portion 3 located at the front end of body 2, and a cap 4 located at the rear end thereof. As can be seen from FIGS. 2 and 3, musical soundinitiating command signal generator 5 and a circuit substrate 6 are provided inside the stick-shaped body, as well as a timbre selecting switch SSW which is located in the center of the stick-shaped body.

Figure 6:
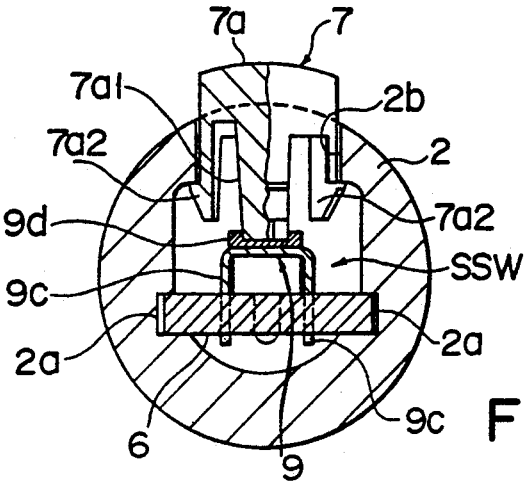
FIG. 6 shows a cross-sectional view along the VI—VI line of FIG. 4.

Stick-shaped body 2 is a hollow cylinder made from ABS resin, formed by injection molding, whose inner wall defines a cavity with a cross section having a rectangular upper half portion and a crescent lower half portion which are separated by a pair of rectangular guiding-and-holding grooves 2*a* formed, at the time of injection molding, to guide and hold the lateral edges of a circuit substrate 6, as illustrated in FIG. 6. Stick-shaped body 2 has a radial hole 2*b* which is located at the middle of its length, so that a push-button may be freely inserted therein, and a grip 2*c* is provided on the surface area beyond the hole, nearer to the rear end of the body.

Head 3, which has a oval tip portion 3*c* and a rear end portion 3*a* with a cross section identical to that of stick-shaped body 2, is made from hard resin such as ABS resin, and is designed to transmit accelerations and decelerations occurring due to the vibration of the striker, which is produced when it is struck or oscillated against a drum, a book, a desktop or the like, to musical sound-initiating command signal generator 5. Except for its rear end portion, head 3 is covered with a protective cover 3*b* made of soft resin, such as urethane resin.

Figure 2:
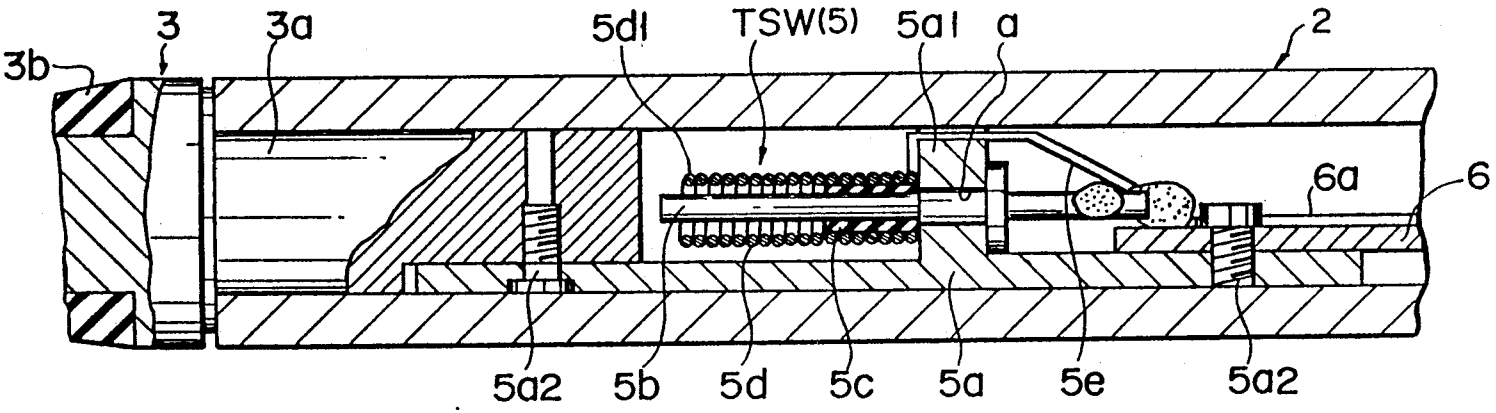
FIGS. 2 and 3 respectively show an enlarged longitudinal cross section and an enlarged transverse cross section of the principal part of the musical sound-initiating command signal generator of the above embodiment.
Figure 3:
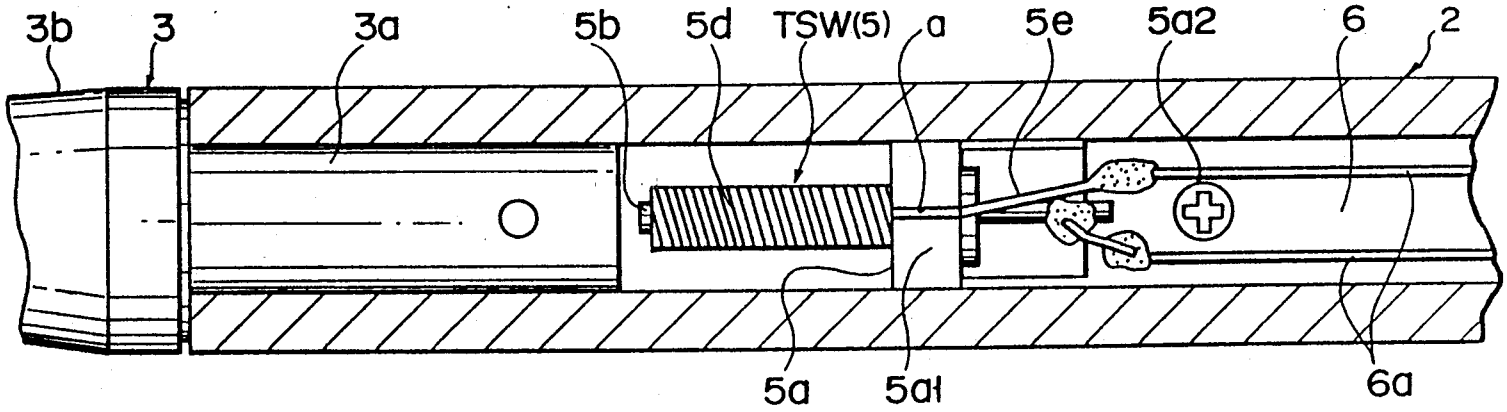

Musical sound-initiating command generator 5 performs a switching action when head 3 strikes or oscillates, to transmit a predetermined musical soundinitiating command signal, so as to produce a desired musical sound from a musical sound producing unit 11, and comprises, as can be seen most clearly from FIGS. 2 and 3, a conductive member 5*b* securely fitted on a support base 5*a*, insulating member 5*c* securely fitted around the conductive member 5*b*, and a conductive coil spring 5*d* whose lower extremity is securely fitted on the outer circumference of the insulating member 5*c*. In other words, support base 5*a* is an elongated plate of hard resin, such as ABS resin, having a column-shaped fitting member $5a_1$ standing at the middle of its length. One end of support base 5*a* (the leftside end in FIG. 2) is securely held on head 3 by means of a screw $5a_2$, while its other end is securely held on circuit substrate 6 by means of a screw $5a_2$. Conductive member 5*b* is a metal rod and is fitted to the center of support base 5*a*, in alignment with the longitudinal axis of stick-shaped body 2, with one of its ends horizontally extending toward the front end of the body, and its other end extending toward the rear end of the body to be soldered to connector chip 6*a* of circuit substrate 6. Insulating member 5*c* has a tubular configuration and is securely fitted to the circumference of one end of conductive member 5*b*. Coil spring 5*d*, which is made from conductive metal, is designed to be flexibly deformed in accordance with vibration of head 3, and detachably in contact with the pole of conductive member 5*b*. The rear end portion of coil spring 5*d* helically surrounds the circumference of insulating member 5*c* and then extends further, through a notch formed on the top of fitting member $5a_1$, to connector chip 6*a* of circuit substrate 6, where the very end of the coil is soldered thereto.

As is shown in FIGS. 2 to 6, circuit substrate 6 is an elongated plate, on the upper surface of which are provided connector chip 6*a* and electronic parts (not shown), as well as contact plates 8 and 9 of timbre selecting switch SSW. Circuit substrate 6 is introduced into stick-shaped body 2 from the front end (the leftside end in FIG. 2), with its lateral edges being guided along guiding-and-holding grooves 2*a*, which are formed on the inner surface of body 2, to predetermined positions, so as to be securely fitted thereto.

Figure 4:
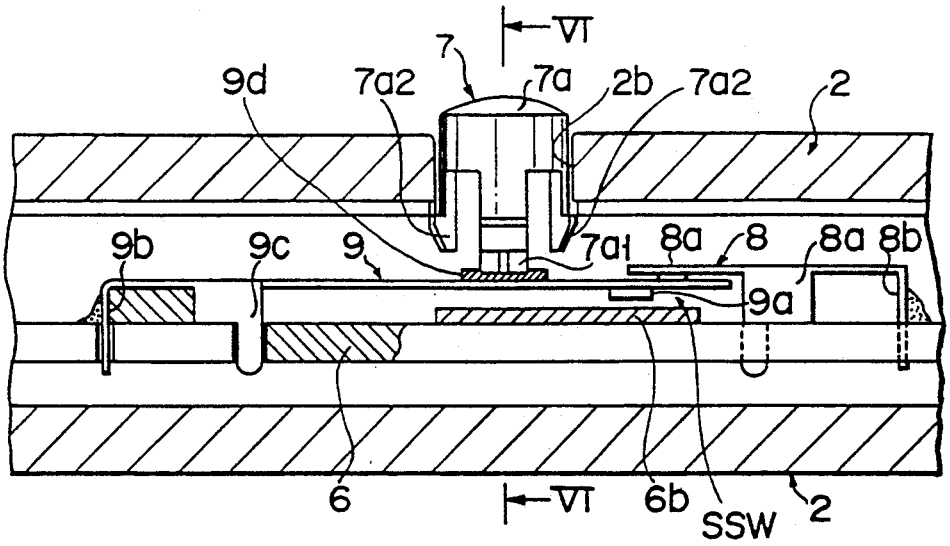
FIGS. 4 and 5 respectively show an enlarged longitudinal cross section and an enlarged transverse cross section of the principal part of the timbre selecting unit of the above embodiment.
Figure 5:
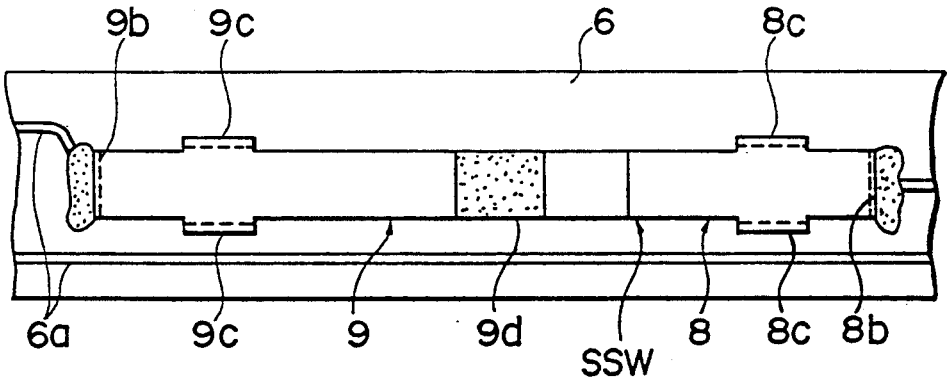

Timbre selecting switch SSW is designed to shift the timbre of the sound to be produced by the instrument and, as is shown in FIGS. 4 and 6, comprises a pushbutton 7*a* and first and second contact plates 8 and 9. Pushbutton 7*a* has the configuration of an inverted bucket, and comprises a central depressor portion $7a_1$ and a number of peripheral elastic hoods $7a_2$ . . . provided to prevent the pushbutton from coming off from hole 2*b*, so that when depressed, it will smoothly enter stick-shaped body 2, to push down second contact plate 9 and return to its original position relative to the outer surface of body 2, when it is released. First and second contact plates 8 and 9 are metal leaf springs, comprising respective contact chips 8*a* and 9*a* at their opposed front ends, and respective longitudinal legs 8*b* and 9*b* and radial legs 8*c* and 9*c* at their remote ends, which are soldered onto circuit substrate 6. Thus, contact plates 8 and 9 are electrically connected to substrate 6. The front end of first contact plate 8 is located laterally apart from pushbutton 7*a*, whereas the front end portion of second contact plate 9 passes under pushbutton 7*a* and reaches the lower surface of first contact plate 8, thereby to come permanently into contact with the latter, so long as the former is not pushed down. When pushbutton 7*a* is depressed, second contact plate 9 is pushed down by depressor $7a_1$, via a felt chip 9*d*, and contact chip 8*b* comes into contact with stationary contact point 6*b* located on circuit substrate 6. Circuit substrate 6 is electrically connected with a flexible cord 10 via a connector (not shown). Flexible cord 10 extends from body 2, through cap 4, which is located at the rear end of body 2, to musical sound producing unit 11, which produces desired musical sounds. Musical sound producing unit 11 can produce a musical sound not only when striker 1 is made to strike, but also when any of a plurality of drum pads 12 provided on the upper section of the unit is depressed and when any bar of keyboard 13 is depressed, in the latter case the keyboard being able to be operated like any other ordinary keyboard instrument.

The above-described components are assembled to form a striker 1 in the following manner:

Rod-shaped conductive member 5*b*, insulating member 5*c*, and coil spring 5*d* of musical sound-initiating signal generator 5 are fitted to support base 5*a*, prior to the assembly operation. One end of the aggregate of the signal generator 5 is then rigidly fitted, by means of a screw $5a_2$, to rear end portion 3*a* having a diameter of stick head 3, and its other end is rigidly fitted, also by means of a screw $5a_2$, to the end of circuit substrate 6, while conductive member 5*b* and coil spring 5*d* of signal generator 5 are electrically connected to circuit substrate 6. First and second contact plates 8 and 9 are fitted to circuit substrate 6, prior to the assembly operation.

Circuit substrate 6, to which musical sound-initiating command signal generator 5 and stick head 3 are mechanically and electrically connected, is then introduced into stick-shaped body 2, from its front end (the leftside end in FIG. 2), by sliding the lateral edges of head 3 along guiding-and-holding grooves 2*a*, until rear end portion 3*a* of head 3 is completely concealed within body 2, where musical sound-initiating signal generator 5 and circuit substrate 6 reach their respective proper locations and second contact plate 9 of timbre selecting switch SSW, provided on circuit substrate 6, faces radial hole 2*b* of body 2 of pushbutton 7*a*.

When circuit substrate 6 is placed in this location, pushbutton 7*a* of timbre-selecting switch SSW is introduced into button hole 2*b*. Then, central depressor portion $7a_1$ is positioned, with respect to felt chip 9*d* on contact plate 9, so that it comes into contact therewith, and is constantly pushed upward by plate 9. Nevertheless, pushbutton 7*a* will not come out through button hole 2*b*, because it is anchored by elastic hooks $7a_2$ to the periphery thereof. Then, cord 10 is attached to the rear end of circuit substrate 6, and the rear end plug (not shown) of cord 10 is inserted into the jack of musical sound producing unit 11, to establish an electrical connection between circuit substrate 6 and the sound source-driving device and two loudspeakers SP of musical sound producing unit 11.

Now, by referring to FIG. 7, the circuit configuration used in the embodiment will be described below.

Figure 7:
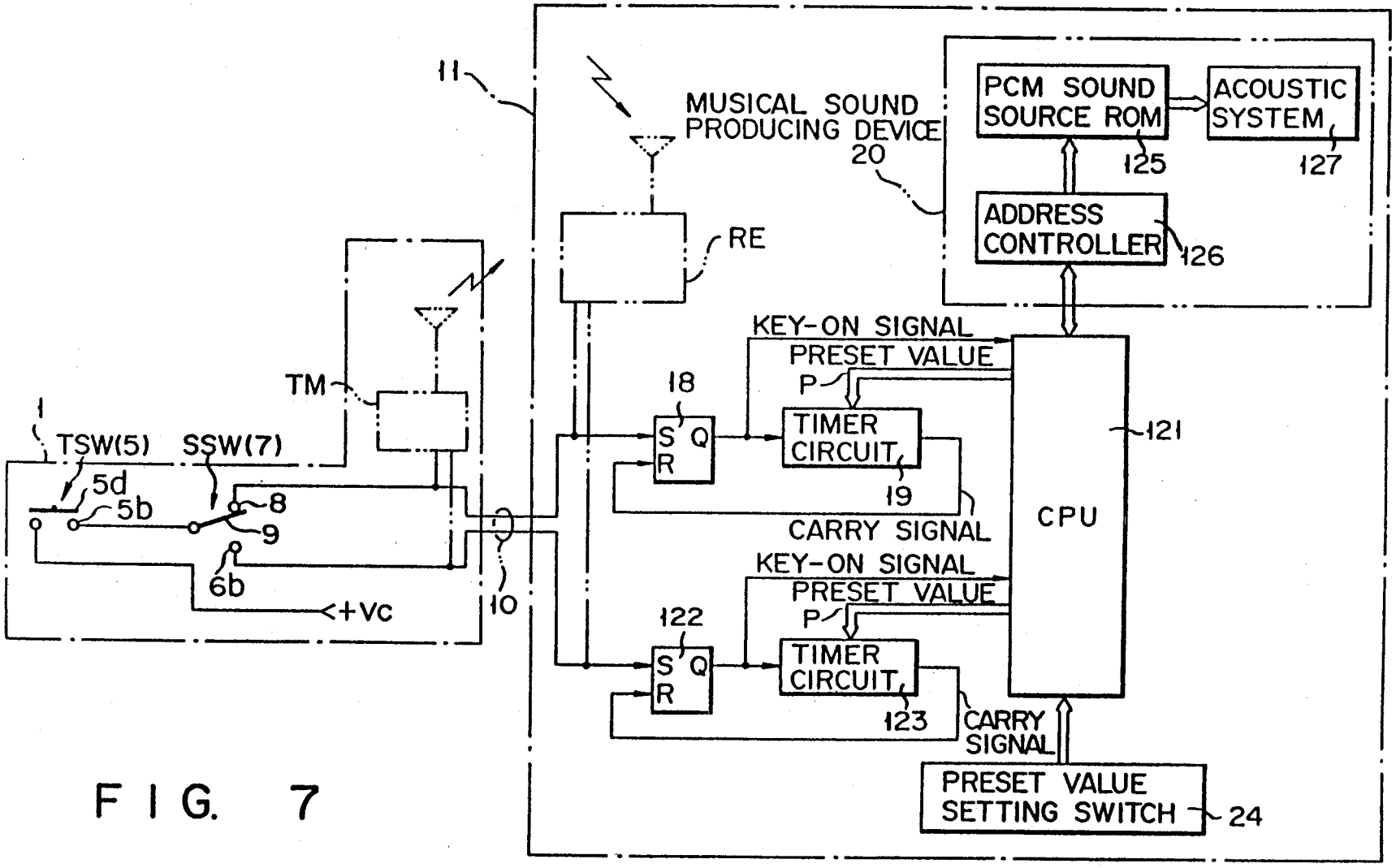
FIG. 7 shows a circuit diagram of the electric circuit to be used in the above embodiment.

As is shown in FIG. 7, musical sound producing unit 11 comprises a flip-flop circuit of RS type 18 (hereinafter referred to as "RS F/F"), which is placed in a "set" condition when its set-input terminal S receives a musical sound-initiating command signal generated in response to a switching-on action of musical sound-triggering switch TSW, which occurs when striker 1 is made to strike while timbre selecting switch SSW remains undepressed. Output terminal Q of RS F/F 18 is connected to a timer circuit 19 which starts measuring the elapse of a predetermined time period, the so-called chattering reference time (t), when the first key-on signal is transmitted from output terminal Q, in response to the switching-on action of triggering switch TSW, and with CPU (central processing unit) 121, which controls musical sound producing device 20 in such a manner that the latter always produces a musical sound in response to a key-on signal. The output terminal of timer circuit 19 transmits a carry signal (reset signal) when a predetermined time period, or so-called chattering reference time, has elapsed after the generating of the first key-on signal in response to the first strike or oscillation of striker 1, in order to prevent any possible production of undesired sounds arising from chatterings which may occur when striker 1 strikes and coil spring 9 is consequently caused to vibrate. The carry signal is then sent to reset-input terminal R of RS F/F 18, to place it in a "reset" condition, where it is then ready to accept another signal output from switch TSW. As has been described above, timer circuit 19 measures the elapse of chattering reference time (t), after the generation of the key-on signal, in response to the first strike of striker 1, the reference time being determined on the basis of preset time value data supplied by CPU 121, with due regard to both the time interval elapsing between any two successive strikes of a given barrage of strikes by striker 1, and the actual elapse of time from the first strike to the occurrence of chattering after the strike. If the chattering reference time (t) is set to be sufficiently long, without considering the time interval which will elapse between two successive strikes of striker 1, the "set" condition of RS F/F 18, which is established in accordance with the first key-in signal generated for a strike by striker 1, also becomes long enough to prevent transmission, to CPU 121, of a second key-on signal which may be accidentally generated as a result of chattering occurring shortly after the first key-on signal is generated and, consequently, the producing of an undesired sound by musical sound producing device 20 is prevented. On the other hand, if the reference time (t) is set too long, a second key-on signal, which may be generated before the elapse of the time (t), because two successive strikes by striker 1 occur in quick succession, i.e. with a very short time interval therebetween, will not be transmitted to CPU 121, and the desired musical sound corresponding to the second key-on signal will not be produced. Therefore, the reference time (t) is set to a value which is greater than the longest possible time interval ($t_1$) between a first strike and a first chattering and less than the shortest possible time interval ($t_2$) between a first strike and a second strike of a barrage of strikes by striker 1.

Now, any musical sound-initiating command signals which are generated while timbre selecting switch SSW is kept depressed, are supplied to the set-input terminal of RS F/F 122, which is incorporated in musical sound producing unit 11, in order to place circuit RS F/F 122 in a "set" condition. RS F/F 122 also comprises a timer circuit 123 which is connected thereto, and RS F/F 122 and timer circuit 123 cooperate to prevent any chatterings, by nullifying the possible effects created by any unintended movement of musical sound-triggering switch TSW.

Thus, the timbre selecting operation performed in this embodiment is effected by means of timbre selecting switch SSW. That is, when striker 1 is made to strike while timbre selecting switch SSW is depressed, CPU 121 triggers the generation of one of the timbres, whereas when striker 1 strikes while timbre selecting switch SSW is not depressed, CPU 121 triggers the generation of another timbre.

In the present embodiment, it should be noted that a switch 24 is provided in CPU 121, so that the player can, either manually or by operating a pedal, variably control the reference time (t) of the two timer circuits 19 and 123, according to his or her own wishes.

Musical sound producing device 20, which is essentially a pulse code-modulation (PCM) system, comprises a PCM sound source ROM 125 which permanently stores data for a plurality of percussive musical sounds, sampled musical sounds and other sounds, an address controller 126 which, according to the control data from CPU 121, controls the operation of reading out the sound source data stored in PCM sound source ROM 125, to be performed in response to the key-on signals which are generated when striker 1 is made to strike, and an acoustic system 127 which produces musical sounds in response to the sound source data read out from PCM sound source ROM 125, in accordance with the control data transmitted from address controller 126.

The operation of the striker of the above-described electronic percussion instrument will now be described in detail.

Prior to the instrument being played, two different timbres, for example, a bass-drum timbre and high-hat timbre, are selected by using the timbre-selected buttons 23A located on musical sound producing unit 11.

When tip portion 3*c* of striker 1 strikes, it produces a musical sound having one of the preselected timbres (the bass-drum tone, for example) if timbre selecting switch SSW (pushbutton 7*a*) is not depressed, and a musical sound having the other timbre (consequently, the high-hat timbre), if timbre-shift switch SSW (pushbutton 7*a*) is depressed.

Let us look more closely into the case where striker 1 strikes while timbre-shift switch SSW (pushbutton 7*a*) remains undepressed.

If tip portion 3*c* of striker 1 strikes and is caused to decelerate, for example, under this condition, coil spring 5*d* is caused to vibrate and its free end $5d_1$ comes into electrical contact with conductive member 5*b*. This electrical contact causes a switching-on of musical sound-triggering switch TSW, which consists of coil spring 5*d* and conductive member 5*b*, and which transmits, in its turn, a corresponding musical sound-initiating command signal. The musical sound-initiating command signal transmitted from switch TSW goes into set-input terminal S of RSF/F 18 located within musical sound producing unit 11, shown in FIG. 7, via cord 10 connecting striker 1 and sound producing unit 11, to place RS F/F 18 in a "set" condition. This "set" condition causes a key-on signal to be transmitted from output terminal Q of RS F/F 18, the signal being received by timer circuit 19 and, at the same time, by CPU 121. When CPU 121 proceeds to a data-processing procedure for production of a musical sound upon receiving the key-on signal, it checks RS F/F 18 to find out if the signal was generated while timbre selecting switch SSW was depressed or not and, upon finding that the latter is the case, specifies a bass-drum timbre as the musical sound to be produced. CPU 121 then combines the timbre-specifying data with the musical sound control data, and sends them to address controller 26. Upon receiving the data, address controller 126 transmits address control data to PCM sound source ROM 125 for reading out one of the sound source data stored therein for bass-drum timbre, and sends it to acoustic system 127, so that the desired bass-drum sound is emitted from the speakers constituting acoustic system 127. (See FIG. 1.)

On the other hand, timer circuit 19, upon receiving the key-on signal generated through the striking of striker 1, starts measuring the elapse of the time which is preset by time preset switch 24 and, when the preset time has elapsed, transmits a carry signal to RS F/F 18, to place it in a "reset" condition. Now assume that the striking of striker 1 causes chattering between coil spring 5*d* and conductive member 5*b*, which in turn causes switch TSW to generate one or more undesired musical sound-initiating command signals within a very short period of time. Even if, however, such signals are generated by switch TSW, they are not transmitted from RS F/F 18, as so many key-on signals, unless timer 19 transmits a carry signal to place RS F/F 18 in a "reset" condition, so that the emission of any undesired sounds may be prevented in advance. If, on the other hand, striker 1 strikes for the second time in a successive manner, shortly after the first strike, when RS F/F 18 has already been returned to a "reset" condition, flip-flop circuit 18 is ready to receive the electric signal coming from musical sound-triggering switch TSW and transmit a corresponding key-on signal, so that a second bass-drum sound is emitted from the speakers of acoustic system 127.

Now, the case will be discussed where striker 1 while timbre selecting switch SWW is depressed.

When switch SSW (pushbutton 7*a*) is depressed, second contact plate 9 is lowered by central depressor portion 7*a*, of pushbutton 7*a* and is separated from first contact plate 8, to come into contact with stationary contact 6*b*. If tip portion 3*c* of striker 1 strikes under this condition, coil spring 5*d*, located inside striker 1, is vibrated as described earlier, and causes a switching-on of musical sound-triggering switch TSW, which generates a musical sound-initiating command signal. Now, since timbre selecting switch SSW is depressed, the signal is detected not by RS F/F 18, as in the above-described case, but by RS F/F 122 when checked by CPU 121. Thus, CPU 21 combines different timbre-specifying data, or the data which specifies the high-hat timbre, with the musical sound control data for processing, and transmits this combined data to the address controller 126. Accordingly, the sound source data for the high-hat timbre is read out from PCM sound source ROM 125, so that a musical sound having the high-hat timbre is emitted from the speakers of acoustic system 127. As has been described earlier, in connection with the bass-drum timbre, a carry signal (reset signal) is transmitted from timer circuit 123, when the chattering reference time (t) has elapsed after the generating of the key-on signal, in order to place RS F/F 122 in a "reset" condition so that it is ready to accept the next signal from switch TSW.

It may be appreciated from the above description that the embodiment of the present invention possesses the following advantages over the known electronic percussion instruments:

Firstly, since unlike the striker of an electronic percussion instrument of the prior art, which comprises piezo-electric elements, striker 1 of the above embodiment contains musical sound-initiating command signal generator 5 which comprises mechanical switching elements of a conductive coil spring **5*d* and rod-shaped conductive member 5*b***, not only can it be constructed relatively simply and inexpensively but will also not degrade with time, and will ensure the generating of musical sound-initiating command signals of a given level for a long period of time. Use of mechanical switching elements instead of piezo-electric elements also ensures that the striker will produce a desired musical sound not only when it is made to strike, but also when it is swung, thus allowing variegated playing performances, using the striker.

Secondly, since striker 1 is provided with a timbre selecting switch SSW, a plurality of tones can be selectively used during a playing performance, by way of a simple tone-selection operation.

Figure 8:
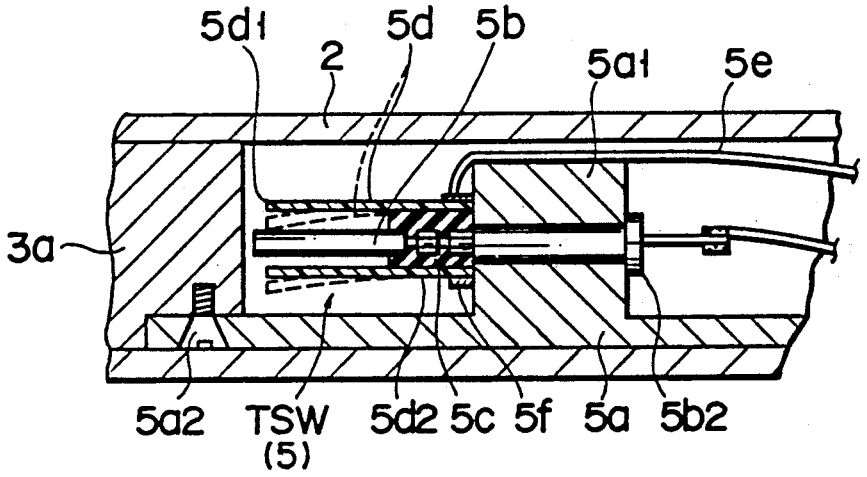
FIG. 8 shows an enlarged cross section of an alternative conductive elastic member to be used in the above embodiment.

While musical sound-initiating command generator 5 of the above embodiment has a configuration comprising a rod-shaped conductive member **5*b*, an insulating member 5*c*, and a conductive coil spring 5*d*, generator 5 can alternatively have a configuration as illustrated in FIG. 8**.

In this alternative configuration, a bolt-shaped stationary contact member **5*b* runs through a support body 5*a* which is rigidly held on stick-shaped body 2, the inner surface of its broadened head portion $5b_2$ abutting against a side wall of support base 5*a* and being held rigidly by the latter. The tail end portion of stationary contact member 5*b*, which protrudes from the other side of support base 5*a* is covered by a cylindrical insulating member 5*c*, the former having a stepped outer surface and the latter having a correspondingly stepped inner surface to ensure their mutually secure engagement. The outer surface of insulating member 5*c* is covered by base member $5d_2$ of an elastic and conductive tubular member 5*d* which functions as a movable contact, the periphery of base member $5d_2$ being held rigidly by a cylindrical conductive member 5*f* which anchors conductive member 5*d* to support base 5*a*. Elastic and conductive tubular member 5*d* and bolt-shaped stationary contact member 5*b* are arranged coaxially in such a manner that free end $5d_1$ of elastic and conductive tubular member 5*b* and the front end portion of bolt-shaped stationary contact member 5*b* are normally held a constant distance apart from each other, but when striker 1 accelerates and/or decelerates as it strikes or is oscillated, free end $5d_1$ of tubular member 5*d* vibrates and eventually comes into contact with the front end portion of stationary contact member 5*b*, as is shown by the dotted lines in FIG. 8**.

Whether, tip **3*c* of free end $5d_1$ comes into contact with the front end portion of contact member 5*b*, with a relatively small impact of strike of tip 3*c*, or with a relatively small momentum of oscillation of tip 3*c*, depends on the design of striker 1, and is determined as a function of the dimensions of stationary contact member 5*b* and elastic and conductive tubular member 5*d***, as well as of the moduli of elasticity of the various materials involved.

As can be seen from FIG. 8, musical sound-triggering switch TSW of this alternative configuration has a very simple construction, and has an advantage over the switch shown in FIG. 3, in that it incorporates an elastic and conductive tubular member **5*d* which is less yielding to stress and less prone to deformation and, therefore, to faulty contact with the stationary contact member, even after long use, than coil spring 5*d* of the switch shown in FIG. 3, thereby contributing to the enhanced durability of striker 1**.

Whereas the above embodiment has a connection cord 10 between striker 1 and musical sound producing unit 11, for supplying the latter with musical sound-initiating command signals, striker 1 may alternatively be provided with an FM transmitter TM, and musical sound producing unit 11 may be provided with a receiver RE, to thereby establish a wireless transmission system between striker 1 and unit 11 as shown with phantom lines in FIG. 7. Such a wireless system ensures less restricted performances than a wired system, because it does not have any cord 10 which could obstruct a player's playing activities.

Stick-shaped body 2 of the above embodiment is made of a one-piece resin cylinder which can be formed in a very simple manner, by injection molding. The inner wall of body 2 is provided with a pair of longitudinal guiding-and-holding grooves **2*a* which respectively guide and hold the lateral edges of circuit substrate 6. This design offers simplicity of construction and assembly of striker 1, because circuit substrate 6 can be introduced into body 2 simply by inserting its lateral edges into guiding-and-holding grooves 2*a***, without the need for any positioning operations.

Figure 9:
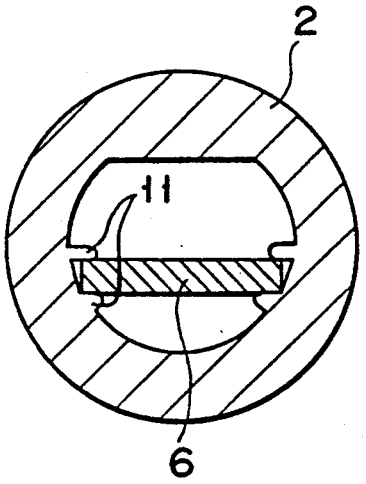
FIG. 9 shows a cross section of an alternative circuit substrate holding mechanism to be used in the above embodiment.

While a pair of rectangular grooves **2*a* are provided on the inner wall of stick-shaped body 2 of the above embodiment, a pair of ribs 111 may be alternatively formed on the inside wall of body 2, to securely hold circuit substrate 6 as shown in FIG. 9**.

Figure 10:
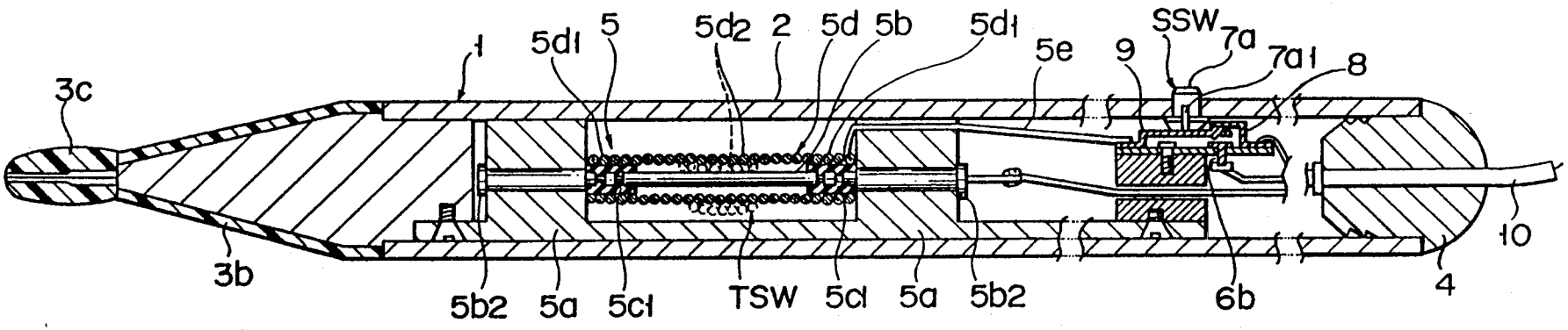
FIG. 10 shows a partial cross-sectional view of a second embodiment of the present invention.

FIG. 10 shows a second embodiment of striker 1 of the present invention, in which the parts and components which are similar to those of the above embodiment are respectively designated by the same reference symbols and their detailed descriptions are omitted.

Musical sound-initiating command signal generator 5 of this embodiment comprises a pair of insulating members $5c_1$ which support a coil spring **5*d*, at their respective extremities $5d_1$, in such a manner that middle portion $5d_2$ of coil spring 5*d* can come into contact with a conductive member 5*b*. Thus, striker 1 comprises a hollow cylindrical stick-shaped body 2, a cap 4 which is inserted into the rear end of body 2, a conical rubber cap 3*b* which covers the front end of body 2, and a playing tip 3*c* fitted to the front end of rubber cap 3*b*. Striker 1 also comprises within its inner cavity a musical sound triggering switch TSW and a timbre selecting switch SSW which are connected to respective leads of a connecting cable 10, so that the status of the switches may be detected by musical sound producing unit 11**. The switches will be described below, in greater detail.

Trigger switch TSW of this embodiment is configured in the following manner:

The end portions of a longitudinally disposed elongated conductive member **5*b*, having the function of a stationary contact respectively running through a pair of supports 5*a* which are rigidly held by on body 2** and the inner surfaces of their broadened head portions $5b_2$, abut the corresponding outer side walls of supports 5a, so that conductive member 5b is held rigidly by supports 5a. The end portions of conductive member 5b located between supports 5a are respectively covered by a pair of cylindrical insulating members $5c_1$, the former having a stepped outer surface and the latter having a correspondingly stepped inner surface, to ensure their mutual secure engagement.

The outer surfaces of insulating members $5c_1$ are respectively surrounded by extremities $5d_1$ of a conductive coil spring 5d which functions as a movable contact in such a manner that the coil spring bridges insulating members $5c_1$. Coil spring 5d and conductive member 5b are arranged coaxially in such a manner that the portion of coil spring 5d arranged between insulating members $5c_1$ and conductive member 5b are held a constant distance apart from each other when striker 1 is not used, but when striker 1 strikes or is oscillated, middle portion $5d_2$ of coil spring 5d vibrates and eventually comes into contact with insulating member 5d, as is indicated by the dotted lines in FIG. 10.

Timbre selecting switch SSW has the following construction:

A pushbutton 7a is located in the button hole of stick-shaped body 2, which is located in an appropriate position for a player to maneuver the switch during a performance, by depressing the pushbutton. The bottom of the pushbutton has a cross-shaped notch to form four flange sections which function as so many leaf springs, to stably maintain contact between the key flange of pushbutton 7a and movable contact member 9. When pushbutton 7a is not used, movable contact member 9 is located in the position shown in FIG. 10, where it is connected to a stationary contact member 8 for "break". When pushbutton 7a is depressed, contact member 9 is lowered and separated the stationary contact member 8 and eventually comes to abut against stationary contact member 6b for "make". As is described later, different timbres are selected when movable contact member 9 is connected to stationary contact member 8, and when it is connected with stationary contact member 6b.

The operation of the above-described embodiment can be easily understood, and hence it will be briefly described hereinafter.

Now assume that tip 3c of striker 1 strikes when timbre selecting switch SSW is not depressed. Coil spring 5d located within striker 1 is caused to vibrate, as a result of the accelerations and decelerations by the striker surrounding the strike, and its middle portion $5d_2$ comes into contact with conductive member 5b. When coil spring 5d and conductive member 5b are electrically connected, musical sound-triggering switch TSW, comprising coil spring 5d and conductive member 5b, is turned on and transmits a predetermined musical sound-initiating command signal. When the signal is received by musical sound producing unit 11, via cord 10 connecting striker 1 and musical sound producing unit 11, the latter produces a corresponding musical sound.

Unlike the first embodiment, which is most clearly illustrated in FIGS. 2, 3, and 8, the above-described embodiment comprises musical sound-initiating command signal generator 5 in which coil spring 5d is supported by a pair of insulative members $5c_1$ located at respective extremities $5d_1$, so that middle portion $5d_2$ of coil spring 5d can come into contact with conductive member 5b, to establish an electrical connection between itself and spring coil 5d. Such a configuration can contain any vibrating of coil spring 5d within a limited amplitude, thereby making it less yielding to stress.

Figure 11:
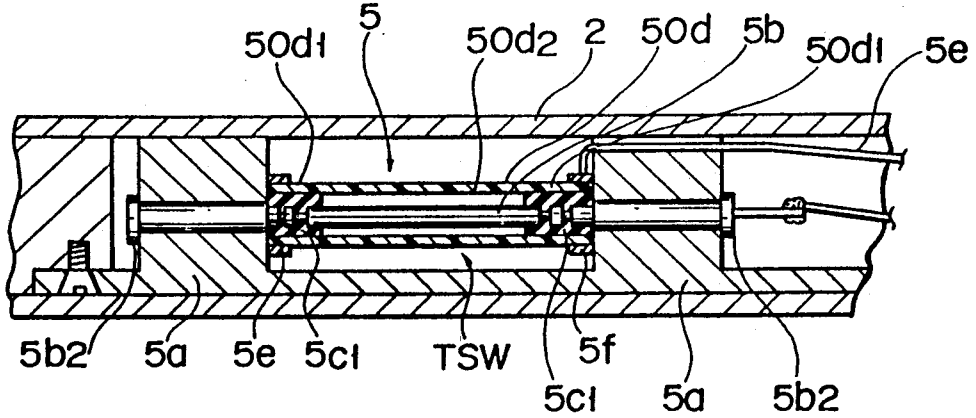
FIG. 11 shows an alternative conductive elastic member to be used in the second embodiment.

Musical sound-initiating command signal generator 5 of the above embodiment can be alternatively configured as shown in FIG. 11. Coil spring 5d, which is used as a conductive member of signal generator 5 in FIG. 10 is replaced by an elastic and conductive cylinder tube 50d, in this alternative configuration. In this configuration, the periphery of each of the two end portions $50d_1$ of cylinder tube 50d, which are securely fitted to respective insulating members $5c_1$, is rigidly surrounded by a conductive anchoring cylinder 5f. One of the advantages which of using an elastic and conductive cylinder tube 50d is that, while a coil spring is subject to stress yielding after a long period of use, and becomes unable to ensure accurate triggering actions of musical sound-triggering switch TSW, an elastic and conductive cylinder tube is less prone to yield and deformation and, accordingly, more durable in use.

Figure 12:
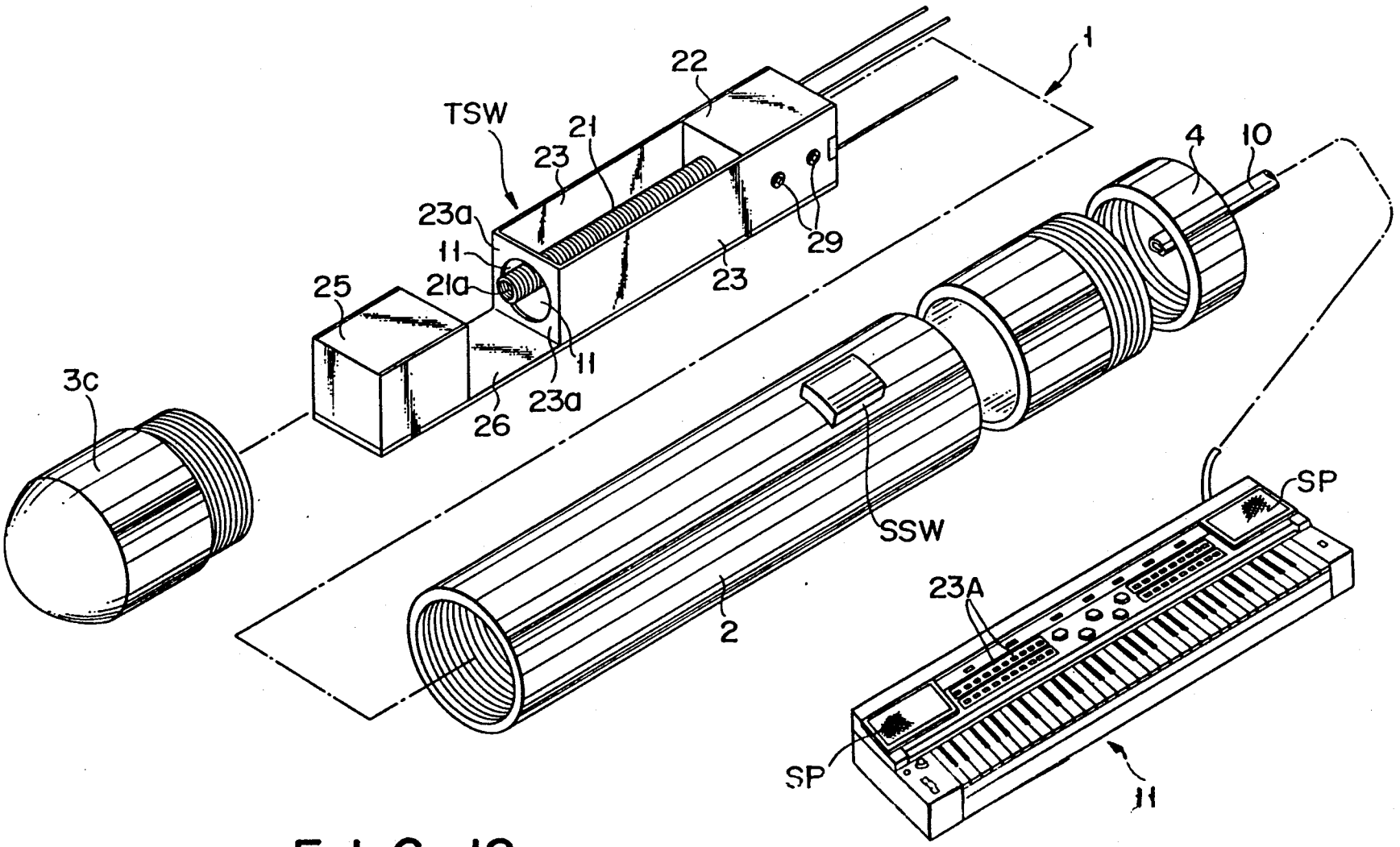
FIGS. 12 and 13 respectively show an exploded perspective view and a longitudinal cross-sectional view of a third embodiment of the present invention.
Figure 13:
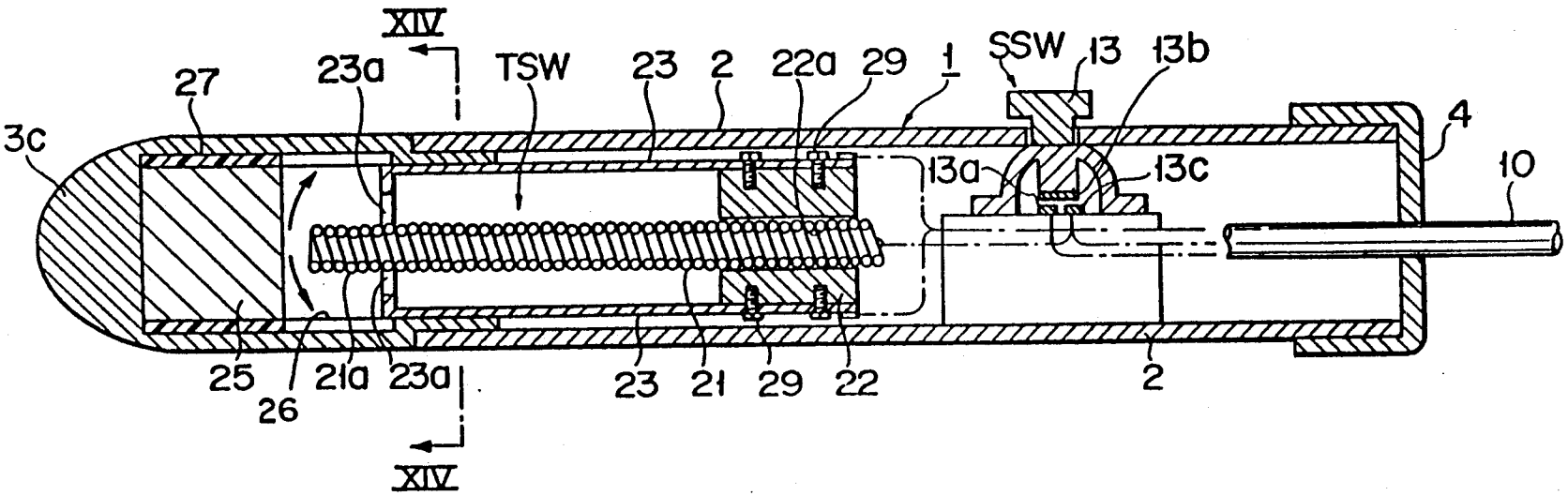
Figure 14:
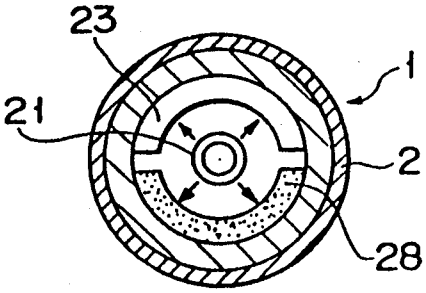
FIG. 14 shows a cross-sectional view along line XIV—XIV of FIG. 13.

FIGS. 12 to 14 show another embodiment of the present invention.

In this embodiment, the musical sound initiating command signal generating means 5 (a musical sound triggering switch TSW) comprises a conductive coil spring 21, and non conductive holder member 22 which rigidly holds one end of the coil spring 21 and a conductive contact member 23 whose one end is also held by the holder member 22.

The configuration of this embodiment will be described below in detail.

As shown in FIG. 12, striker 1, which is struck or swung for playing music during a performance, has a size, an appearance and a shape similar to those of a conventional drumstick. The striker 1 comprises an elongated cylindrical stick-shaped body 2, a hemispheric striker tip 3c located at the front end of the stick-shaped body 2 and a cap 4 located at the rear end thereof. A fitting plate 26 is disposed within the stick-shaped body 2 and is rigidly held to a given position by a positioning member 25. A non conductive holder member 22 is rigidly fitted on the upper surface of the fitting plate 26. A pair of conductive contact members 23, 23 are securely held to the lateral sides of the holder member 22 by screws 29 to form parallel side walls. A conductive coil spring 21, which is designed to become electrically connected with the contact members 23, 23 when the striker 1 is struck or swung, is forcedly fitted into a through bore 22a which is formed at the center of the holder member 22. The coil spring 21 is a movable contact which, along with the stationary contact members 23, 23 constitutes the musical sound triggering switch TSW. Each of the front end portions 23a, 23a of the contact members 23, 23 have a semicircular cut-out area to form a circular opening when they are rectangularly bent and the edges are mutually abutted. The free end portion 21a of the coil spring 21 which runs through the opening comes to be connected with the edge of the opening of the contact member 23 whenever the coil spring 21 is vibrated. A shock-absorbing rubber member 27 is placed between the positioning member 25 and the striker tip 3c to effectively eliminate any possible jars and jolts between them. A timbre selecting switch SSW is provided on the outer surface of the stick-shaped body 2 in an area close to the grip portion of body 2. When the pushbutton switch SSW is depressed, the bridge member 13b, which is located under the switch SSW and inside of the body 2, comes to bridge the two stationary contact members 13*a* and 13*c*. (See FIG. 13.) Thus the timbre of the musical sound produced from the instrument can be shifted through on and off actions of the switch SSW. The coil spring 21 of the musical sound triggering switch TSW and the stationary contact member 13*c* of the timer shift switch SSW are commonly connected with the musical sound producing unit 11 by a branch of a common connector cord 10, while the contact members 23, 23 of the switch TSW are connected by a second branch of the connector cord 10 and the contact member 13*a* of the timbre selecting switch SSW is connected by a third branch of the connector cord 10.

The electronic percussion instrument having the above described configuration is operated in the following manner.

Before starting playing the instrument, two different timbres, for example the bass-drum timbre and the high-hat timbre, are selected by using the timbre select button 23A located on the musical sound producing unit 11. This procedure is identical with that of the previously described embodiments.

Now assume that the tip 3*c* of the striker 1 is struck while the timbre selecting switch SSW is not depressed. The coil spring 21 is caused to vibrate, by accelerations and decelerations of the striker surrounding the the strike, and its free end 21*a* comes to be electrically connected with either one of the contact members 23, 23. This electrical connection gives rise to a turn-on action of the musical sound triggering switch TSW, which consisted of the coil spring 21 and the conductive member 23 and which transmits in its turn a corresponding musical sound initiating command signal. The musical sound initiating command signal transmitted from the switch TSW reaches the input terminal of the musical sound producing unit 11 by way of the cord 10 connecting the striker 1 and the unit 11. As a result, as in the case of the earlier embodiments, a musical sound having the timbre that has been selected by the timbre selecting switch SSW, the bass-drum timbre for example, is emitted from the speakers of the instrument. On the other hand, if the striker 1 is struck or swung while the timbre selecting switch SSW is being depressed, a musical sound having the other selected timbre, for example the high-hat timbre, is emitted from the speakers.

The present invention is not limited by the above described embodiments and a variety of different embodiments may be conceivable within the scope of the present invention.

Whereas in the above embodiments different timbres are selected when the timbre shift switch SSW is depressed and when it is not depressed, the timbre selecting switch may be so designed that a timbre shift occurs each time it is depressed. The timbre selecting switch may also be so designed that three different timbres can be preselected and selectively used during a performance.

Whereas a coil spring 21 is used in the third embodiments as described above, it may be replaced by a wire member or any other conductive member.

In the last embodiment, chatterings can occur on the coil spring 21 when the striker 1 is struck or swung, giving rise to undesired musical sounds. To prevent such phenomena from occurring, the musical sound triggering switch TSW may be designed in such a way that it is intrinsically free from chatterings. For example, a buffer member 28 may be disposed on the stationary contact member 23 on the side where it is bumped by the coil spring 21 in order to absorb its restituting energy so that the contact member 23 would not be bumped by the coil spring 21 for the second time. Alternatively, a piece of permanent magnet may be disposed on the contact member 23 in place of the buffer member 28 in order to restrict the rebounding action of the coil spring 21 by the attracting force of the magnet so that the contact member 23 would not be bumped by the coil spring 21 for the second time.

FIGS. 15 to 18 show a fourth embodiment of the present invention in which different timbres can be selectively used by selecting one of a plurality of conductive members which are disposed on so many different spots of strike of the striker 1.

Figure 15:
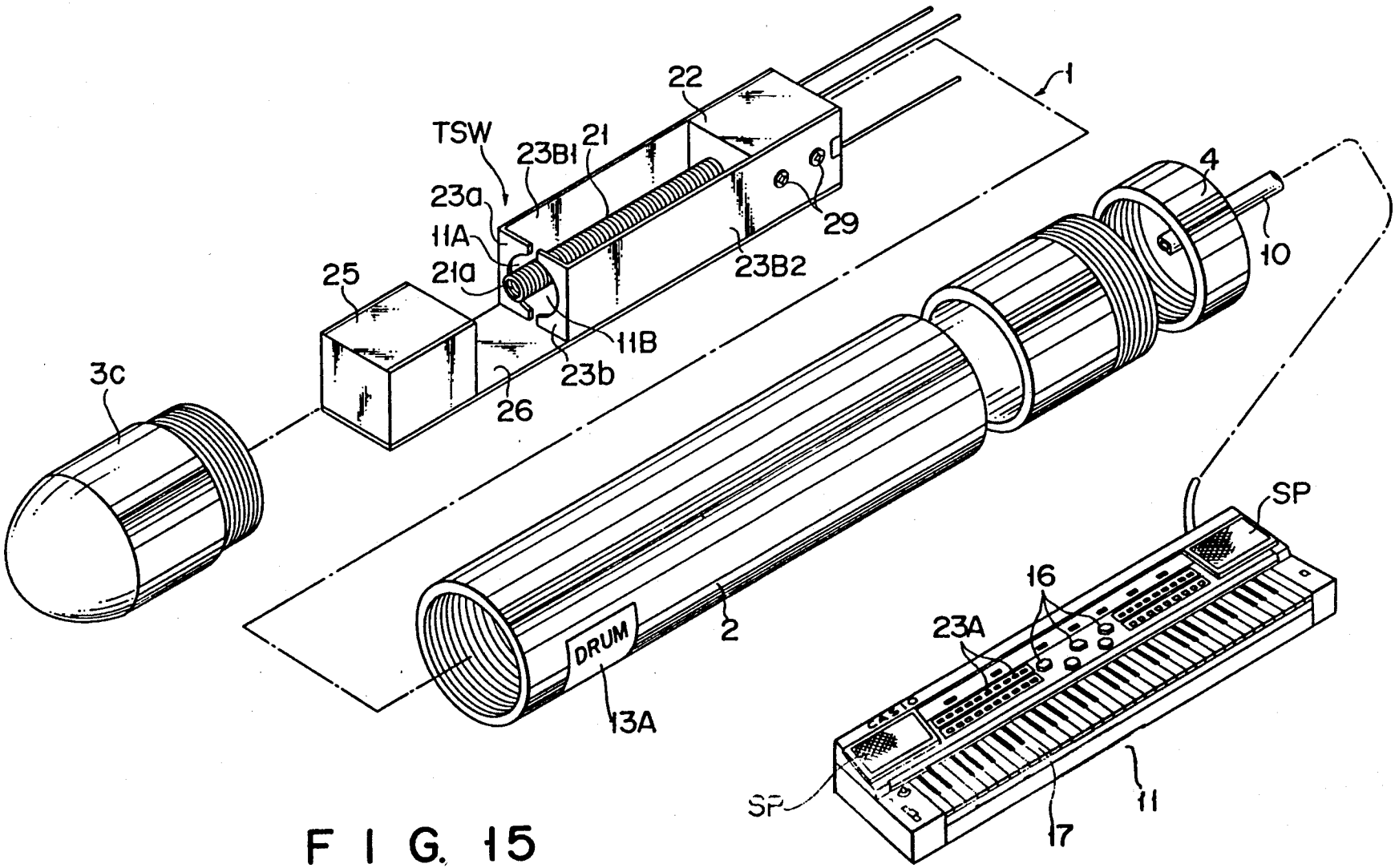
FIGS. 15 and 16 respectively show an exploded perspective view and a longitudinal cross-sectional view of a fourth embodiment of the present invention.

FIG. 15 shows an exploded perspective view of the embodiment. In FIG. 15, the striker is illustrated with an unproportionally enlarged scale as compared with that of the musical sound producing unit.

As shown in FIG. 15, the striker 1, which is struck or swung for playing music during a performance, has a size, and appearance and a shape similar to those of a conventional drumstick. The striker 1 comprises a cylindrical stick-shaped body 2, a hemispheric tip portion 3*c* which is securely held on the front end of the stick-shaped body 2 and a cap 4 which is screwed into the rear end thereof. A fitting plate 26 is disposed within the said stick-shaped body 2 and is rigidly held to a given position by a positioning member 25. A non conductive holder member 22 is rigidly fitted on the upper surface of the fitting plate 26. A pair of conductive contact members 23B1, 23B2 are securely held to the lateral sides of the holder member 22 by screws 29 to form parallel side walls. A coil spring 21, which is designed to become electrically connected with either one of the contact members 23B1, 23B2 when the is striker 1 struck or swung, is forcedly fitted into a through bore 22 which is formed at the center of the holder member 22. The coil spring 21 being a common movable contact member for both of the stationary contact members 23B1, 23B2, it constitutes a first switch section 11A with the contact member 23B1 and a second switch section 11B with the contact member 23B2. The contact members 23B1, 23B2 have their respective front end portions 23*a*, 23*b*, which are perpendicular to the contact members 23B1, 23B2 and each of which has a U-shaped cut-out area in order to ensure a reliable electrical connection between itself and the free end 21*a* of the coil spring 21. (See FIG. 17.) A shock-absorbing rubber member 27 is placed between the positioning member 25 and the striker tip 3*c* to effectively eliminate any possible jars and jolts between them. On the lateral areas of the outer surface of the stick-shaped body 2, which respectively corresponds to the first switch section 11A constituted by the coil spring 21 and the contact member 23B1, and the second switch section 11B constituted by the coil spring 21 and the contact member 23B2, a pair of the timbre indicators 13A, 13A are disposed in order to provide a visual indication of the timbres which are available to the player of the instrument.

One end of the cord 10 is commonly connected with the end portions 23*a*, 23*b* and 21*b* of the pair of contact members 23B1, 23B2 and the coil spring 21, while the other end of the cord 10 is connected with the musical sound producing unit 11 which produces a musical sound in response to a strike or an oscillation of the striker 1.

The electronic percussion instrument having the above described configuration is operated in the following manner.

Before starting playing the instrument, two different timbres, for example the bass-drum timbre and the high-hat timbre, are selected by using the timbre select buttons 23A located on the musical sound producing unit 11.

Figure 16:
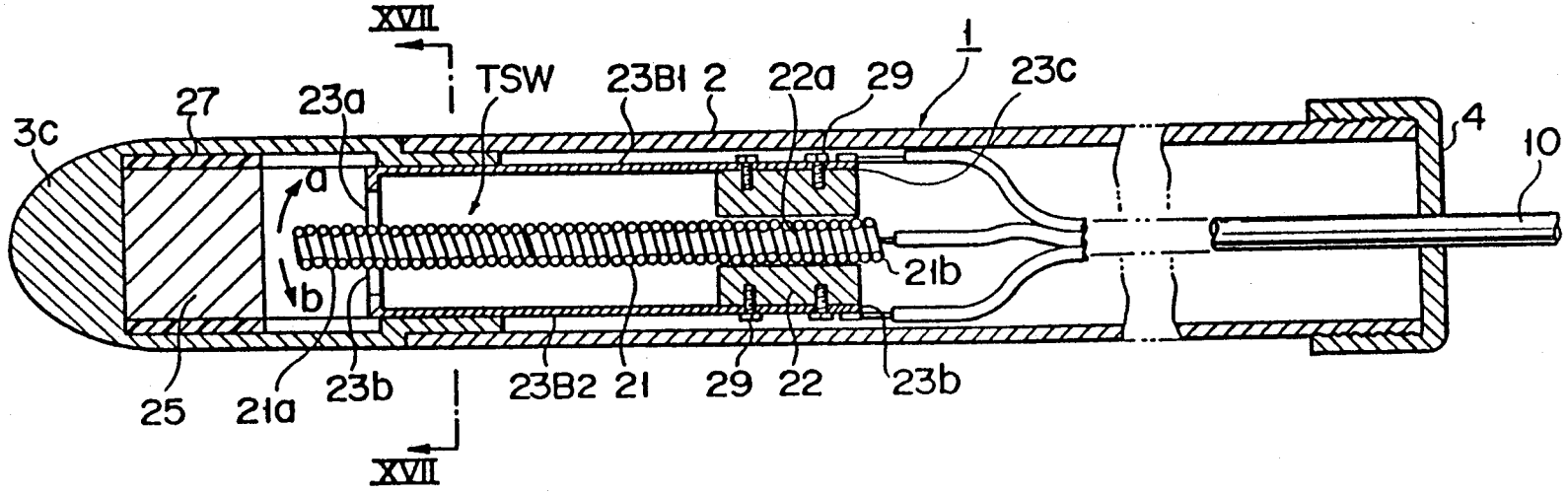
Figure 17:
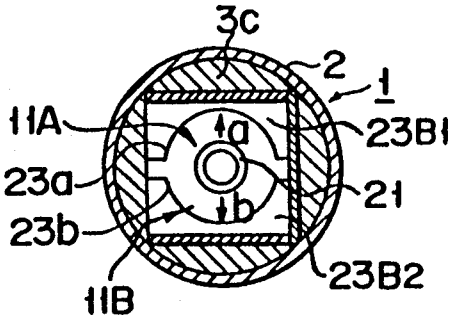
FIG. 17 shows a cross-sectional view along line XVII—XVII of FIG. 16.

Now assume that the upper half area of the tip 3*c*, as shown in FIGS. 16 and 17, of the striker 1 is struck. Then the coil spring 21 located inside of the striker 1 is vibrated and moved toward the direction as indicated by the arrow "a" and its free end 21*a* comes to be electrically connected with the contact member 23B1. This electrical connection causes the first switch section 11A comprising the coil spring 21 and the contact member 23B1 to be turned on to transmit a musical sound initiating command signal. The musical sound initiating command signal transmitted from the first switch 11A is received by the musical sound producing unit 11 via the cord 10 connecting the striker 1 and the musical sound producing unit 11 to emit a sound having the bass-drum timbre from the speakers. When the lower half area of the tip 3*c* as shown in FIGS. 16 and 17, of the striker 1 is struck, then the coil spring 21 located inside of the striker 1 is vibrated and moved toward the direction as indicated by the arrow "b" which is opposite to "a" and its free end 21*a* comes to be electrically connected with the contact member 23B1. This electrical connection causes the second switch section 11B comprising the coil spring 21 and the contact member 23B2 to be turned on to transmit a musical sound initiating command signal, which in turn causes the musical sound producing unit to emit a desired musical sound having the high-hat timbre.

Figure 18:
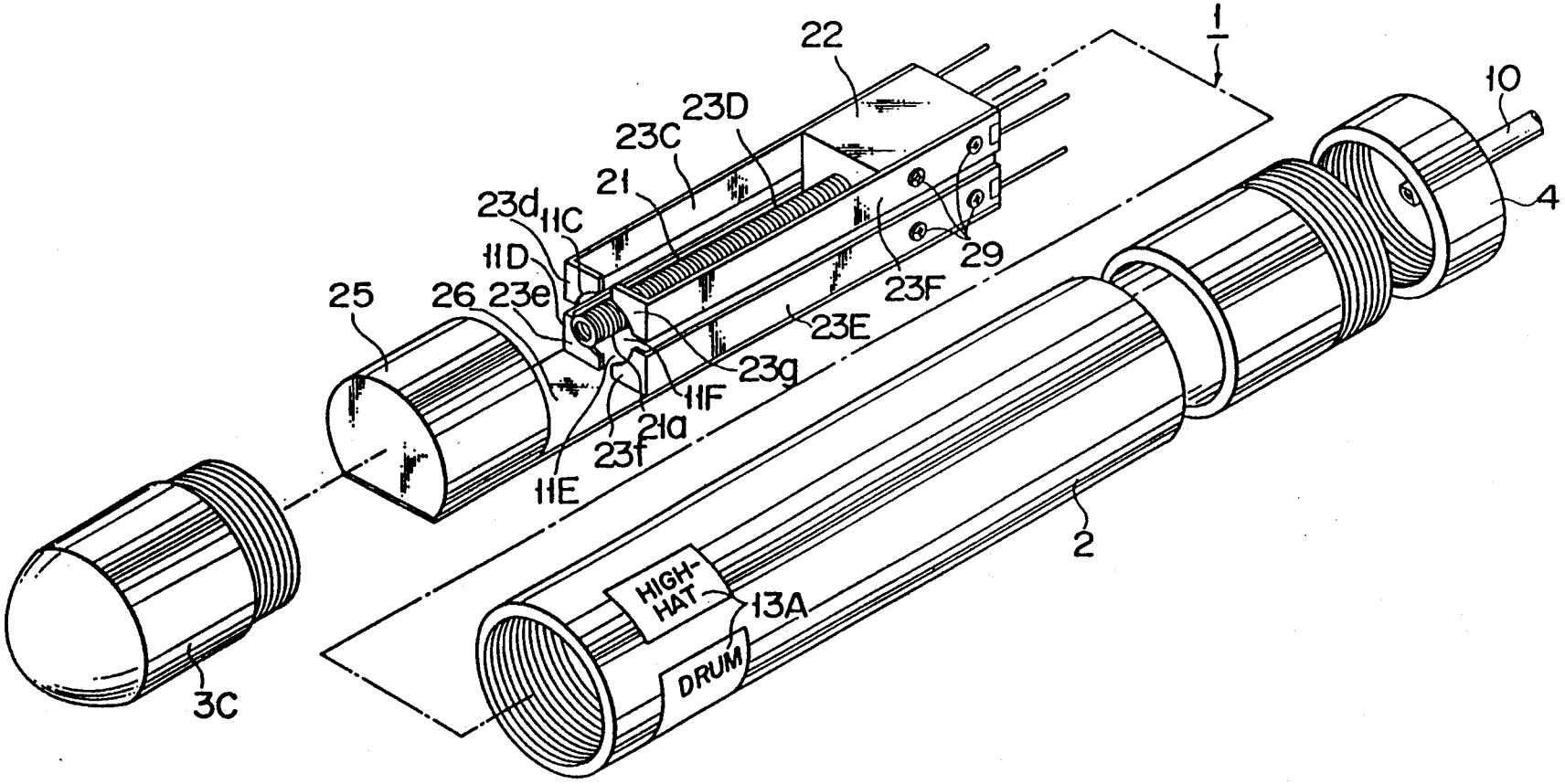
FIG. 18 shows a cut-out perspective view of a striker with which four timbres are selectively provided.

FIG. 18 shows a striker 1 with which, unlike the strikers as described above, four different timbres can be selectively used.

In this striker 1, a holder member 22 is provided inside the stick-shaped body 2, on the lateral sides of which two pairs of conductive contact members 23C to 23F are rigidly held. A coil spring 21, which is disposed longitudinally and parallel to the contact members, is rigidly held to the center of the front side of the holder member 22. The coil spring 21 functions as a common movable contact member for the four stationary contact members 23C to 23F to form four switch sections 11C to 11F with each of the four contact members. The four contact members 23C to 23F have their respective front contact portions 23*d* to 23*f* which are perpendicular to the rest of the members. Each of the four contact members have a timbre indicator 13A to indicate it own timbre.

With a striker 1 which is configured as described above, four timbres can be selectively generated by rotating the striker each time by 90° so that the coil spring 21 may be selectively connected with the contact members 23C to 23F when the striker 1 is struck or swung to bring the four switch sections 11C to 11F into a turned-on state sequentially in order to transmit electric signals to their corresponding RSF/Fs (not shown) within the music sound producing unit 11, which in turn send out key-on signals to emit a musical sound with a selected timbre from the speaker. Since a player using this striker 1 can shift the timbre of the sound produced from the instrument by simply rotating the striker, a very variegated playing performance can be realized with the striker.

Figure 19:
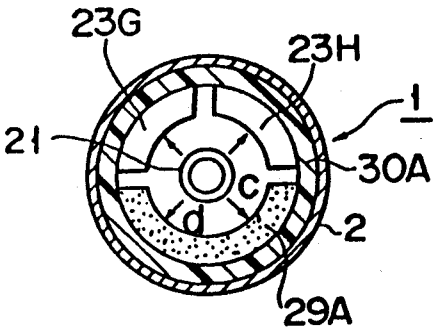
FIG. 19 shows alternative tone selector.

FIG. 19 shows a striker 1 that can prevent occurrence of chatterings of the coil spring 21 even when the striker is strongly struck to cause repeated reboundings of the coil spring.

This striker has a coil spring 21 longitudinally located at the center of the stick-shaped body 2, two contact members 23G, 23H located with a half portion of the body and an insulating member 29A of rubber or some other insulating material located in the other half portion of the body. A buffer member 30A is disposed between the insulating member 29A and the stick-shaped body 1.

A striker 1 having the configuration as described above can prevent any undesired contact of the coil spring 21 and either of the contact members 23G, 23H, because, even when the striker 1 is struck so strongly that the coil spring 21, after coming to contact with either of the contact members 23G, 23H, bounces in either of the directions as indicated by the arrows "c" and "d" to bump the opposite side of the inner wall of the body 2, the energy of the bump is absorbed by the insulating member 29A disposed there. Thus any undesired musical sounds that may be generated due to chatterings of the coil spring 21 can be eliminated. The design of this striker 1 also has the advantage to make any preventive measures unnecessary against chatterings of the coil spring such as a RSF/F or a timer circuit that have to be incorporated within the musical sound producing unit 11 and hence to allow a simplified circuit configuration.

Whereas the above description concerning the function of the strikers is made for the cases where the strikers are struck to cause their respective switches to be turned on, it may be understood that the switches are turned on by an oscillating action of the strikers to perform identical timbre selecting functions. Besides, the coil springs which are used in some embodiments can be replaced by so many conductive wire members. Moreover, whereas the above described embodiments are equipped either with a two timbre selecting function (in the cases of FIGS. 15 to 17) or with a four timbre selecting function (in the case of FIG. 18), they may be provided with a three timbre selecting function or a five timbre selection function by simply increasing the number of contact members involved. Whereas all the above described embodiments are so designed that a musical sound initiating command generating signal is transmitted only when the strikers are struck for the first time, a design in which a musical sound initiating command signal is generated by a chattering which is given rise to by the vibration (or a bounce) of the strikers caused by the first strike and used to produce a musical sound, is conceivable to realize an instrument in which a strike of the striker is accompanied by a number of different musical sounds having different timbres and hence by which very variegated playing performances are possible.

As described above, the present invention provides a musical instrument in which an electrical connection is established by selecting a combination of two conductive members out of a number of possible combinations to selectively use a desired timbre in accordance to the area of the striker surface which is struck, allowing a wide selection of timbres through simply changing areas of the surface of the striker. It may be understood that a very variegated playing performance of a percussion instrument is possible through use of an instrument of the present invention.

FIGS. 20 to 25 show further embodiments of the musical sound initiating command signal generating means according to the present invention. Unlabeled pigtail lines represent electrical connecting leads.

Figure 20:
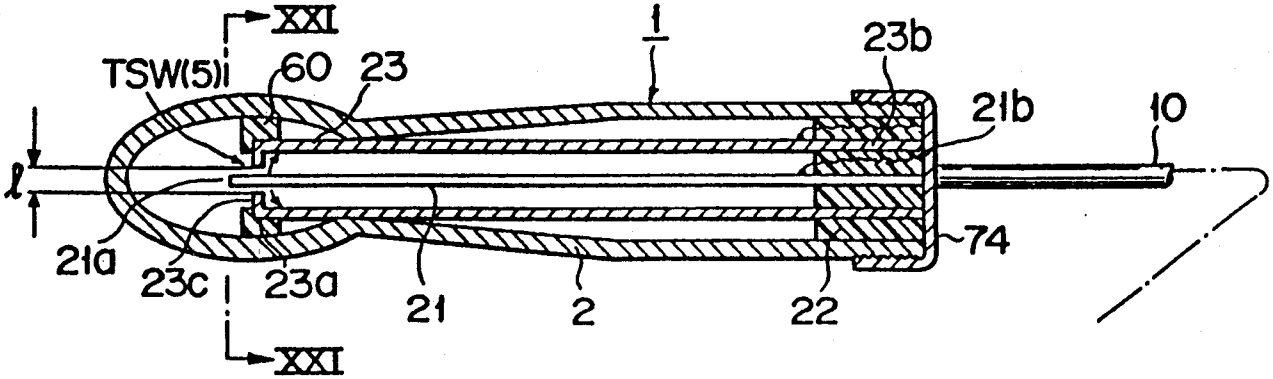
FIG. 20 shows a longitudinal cross section of a fifth embodiment of the present invention.
Figure 21:
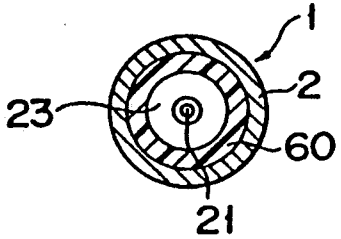
FIG. 21 shows a cross-sectional view along line XXI—XXI of FIG. 20.

FIGS. 20 and 21 show a musical sound initiating command signal triggering switch TSW comprising a conductive wire 21 and a cylindrical contact member 23. As shown in FIG. 20, the stick-shaped body 2 of the striker 1 is a hollow cylinder in which a wire holder member 22 of rubber, plastic or some other insulating material is forcedly fitted under the grip portion of the body. The wire holder rigidly holds in its axial center the basal portion 21*b* of a conductive wire 21 that extends toward the front portion 2. The wire holder 22 also rigidly holds the basal portion 23*b* of a cylindrical contact member 23 which surrounds the wire member 21 and is electrically connected with the free end 21*a* thereof. A ring-shaped contact member 23*c* having an inner diameter (l) is provided around the free end 21*a* of the conductive wire member 21 in order to realize a stable electrical connection between the cylindrical contact member 23 and the conductive wire member 21. A ring bush 60 is disposed between the outer periphery of the front end of the cylindrical contact member 23 and the inner periphery of the stick-shaped body 2 to prevent jars and jolts between them. The rear end of the stick-shaped body 2 is closed by a cap 4 which is screwed into the body 2.

One end of the cord 10 is attached to the rear end portion 21*b* of the conductive member 21 and the rear end portion 23*b* of the cylindrical contact member 23 and the other end of the cord 10 is connected to the musical sound producing unit 11 which produces a desired musical sound when the striker 1 is struck or swung.

An electric percussion instrument having a striker as described above is operated in the following manner.

Assume that desired timbres (for example bass drum and high-hat) are preselected by using the timbre selection switch provided on the musical sound producing unit and then the striker 1 is struck or oscillated. Then the conductive wire 21 provided within the striker is vibrated and eventually comes to be electrically connected with the free end 23*c* of the cylindrical contact member 23. The established electrical connection causes the triggering switch TSW of the musical sound initiating command signal generating means 5 to be turned on and a musical sound initiating command signal to be transmitted from the switch TSW. The electric signal transmitted from the switch TSW is received by the musical sound producing unit 11 via the cord 10 connecting the striker 1 and the unit 10 to emit a desired musical sound from the speakers of the instrument.

Figure 22:
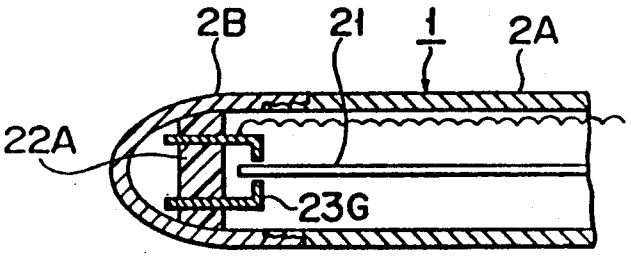
FIGS. 22 to 25 show further embodiments of the present invention.

The embodiment illustrated in FIG. 22 comprises a striker 1 which has a hemispherical tip portion 2B screwed into the front end of the stick-shaped body 2A. Within the tip portion 2B, a cylindrical contact member 23G and a conductive wire member 21 are disposed in such a manner that, when the striker is struck or swung, they come to contact with each other and an electrical connection is established between them. A wire holder member 22A is also provided within the body 2A between them so that the wire member is securely held to it.

With a striker having the above described configuration, the contact member 23G which is longitudinally shorter than the contact member of the striker shown in FIG. 20 can be used to reduce the cost of the material to be used for manufacturing the striker. Moreover, since the tip portion 2B of this embodiment is removable from the stick-shaped body 2A, the operation of mounting the conductive wire 21 and the contact member 23G can be carried out quickly in a reliable manner.

Figure 23:
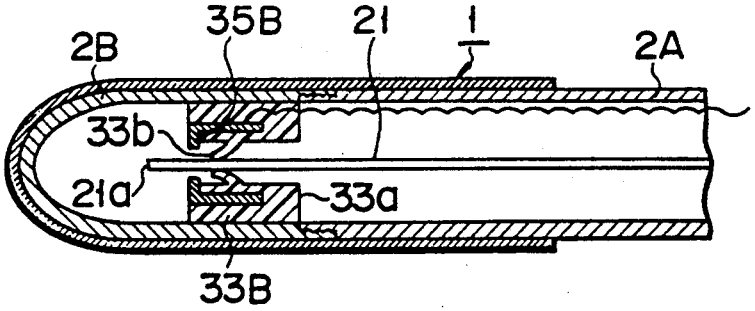

The embodiment illustrated in FIG. 23 comprises a striker 1 which has a hemispherical tip portion 2B fitted onto the front end of the stick-shaped body 2A. Within the tip portion 2B, a cylindrical contact member 35B and a conductive wire member 21 are disposed in such a manner that, when the striker is struck or swung, they come to contact with each other and an electrical connection is established between them. A wire holder member 33B is also provided within the body 2A between them which has a ring-shaped elastic lip portion 33*b* on the inner periphery of a through bore 33*a* formed in the wire holder member 33B to restrict undesired vibration of the free end 21*a* of the conductive wire member 21.

With a striker having the above described configuration, any undesired vibration (chatterings) of the conductive wire member 21 that can occur when the striker 1 is struck is effectively and reliably restricted by the elasticity of the ring-shaped elastic lip portion 33*b*.

Figure 24:
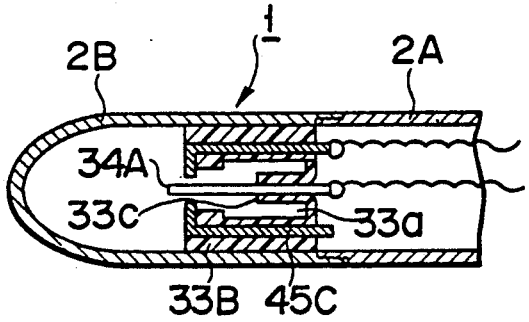

The embodiment illustrated in FIG. 24 comprises, as in the case of FIG. 23, a striker 1 which has a hemispherical tip portion 2B fitted onto the formed end of the stick-shaped body 2A. Within the tip portion, a cylindrical contact member 45C is disposed around a cylindrical wire holder member 33B, which is made of rubber and comprises a ring-shaped elastic holding lip portion 33*c* protruding inwardly from one end of the through bore 33*a* formed in the wire holder member 33B. A conductive wire member 34A which eventually comes into an electrical contact with the contact member 45C is elastically held by the elastic holding lip portion. The elastic holding lip portion 33*c* has an elasticity which suitably prevents chatterings of the conductive wire member 34A that can occur when the striker 1 is struck.

With a striker having a relatively simple configuration as described above, occurrence of any undesired musical sounds due to chatterings that may be produced when the striker is struck can be effectively prevented.

Figure 25:
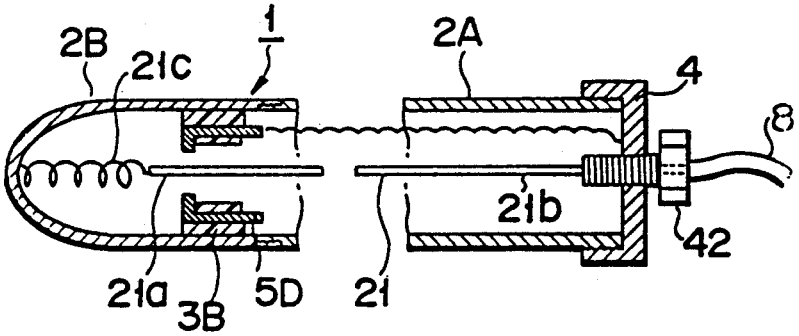

The embodiment illustrated on FIG. 25 comprises a striker 1 which has a hemispherical tip portion 2B. In this embodiment, a coil spring 21*c* is provided between the front end of the tip portion 2B and the free end 21*a* of a conductive wire member 21 and an adjuster 42 is screwed into the basal end portion 21*b* of the conductive coil spring 21 so that the coil spring 21 and the cap 4 fitted on the rear end of the stick-shaped body 2A are engagedly connected.

With a striker having the above described configuration, the tension of the coil spring 21*c* can be suitably adjusted by turning the adjuster 42 prior to use of the striker 1 so that undesired bouncing of the conductive wire member 21 at the time of strike of the striker 1 can be reliably eliminated by the tension of the coil spring 21*c*.

What is claimed is:

1. An electronic percussion instrument, comprising:

a stick-shaped striker which is operated in a striking manner or a swinging manner;

normally open switching means, provided in said striker, for performing switching actions each time said striker is operated in the striking manner or in the swinging manner;

a signal generating means for generating a musical sound initiating command signal each time said normally open switching means performs a switching action; and a musical sound generating means for generating a single musical sound each time the musical sound initiating signal is generated by said command signal generating means;

wherein said normally open switching means comprises:

an undeflectable conductive member having a free end portion and a base end portion fitted in said striker;

an insulating member fitted on an outer surface of the base end portion of the undeflectable conductive member; and a deflectable conductive member, having a free end portion and a base end portion, which is so arranged that its base end portion is fitted on an outer surface of said insulating member and its free end portion (a) is separated by a given distance from the free end portion of said undeflectable conductive member when the striker is not operated in the striking manner or swinging manner, and (b) comes into electrical contact with the free end portion of said undeflectable conductive member by deflecting in accordance with vibration of said striker when said striker is operated in the striking manner or swinging manner.

2. The electronic percussion instrument according to claim 1, wherein said undeflectable conductive member is an elongated rigid conductive member arranged within the striker, in alignment with its longitudinal axis.

3. The electronic percussion instrument according to claim 1, wherein said deflectable conductive member is made from a helically wound conductive spring.

4. The electronic percussion instrument according to claim 1, wherein said deflectable conductive member is made from an elastic and cylindrical conductive tube.

5. The electronic percussion instrument according to claim 1, further comprising a timbre-selecting means, for providing a desired timbre to the musical sound to be generated when the striker is operated in the striking manner or swinging manner.

6. An electronic percussion instrument, comprising:

a stick-shaped striker which is operated in a striking manner or a swinging manner;

normally open switching means, provided in said stick-shaped striker, for performing switching actions each time said striker is operated in the striking manner or in the swinging manner a signal generating means for generating a musical sound initiating command signal each time said normally open switching means performs a switching action;

a musical sound generating means for generating a single musical sound each time the musical sound initiating commmand signal is generated from said signal generating means; and signal transmitting means for transmitting said musical sound initiating command signal to said musical sound generating means each time the command signal is generated from said signal generating means;

wherein said normally open switching means comprises:

an undeflectable conductive member having a pair of base end portions fitted in said striker;

a pair of insulating members fitted respectively on an outer surface of the pair of base end portions of said undeflectable conductive member; and a deflectable conductive member, having respective base end portions at its ends and a middle portion therebetween, which is so arranged that its base end portions are fitted on the outer surface of each of said pair of insulating members and its middle portion is separated from said undeflectable conductive member by said pair of insulating members when said striker is not operated in the striking manner or swinging manner, and its middle portion comes into electrical contact with said undeflectable conductive member by deflecting in accordance with vibration of said striker when the striker is operated in the striking manner or swinging manner.

7. An electronic percussion instrument, comprising:

a stick-shaped striker which is operated in a striking manner or a swinging manner;

musical sound initiating command signal generating means provided in said stick-shaped striker and including switching means for performing switching actions each time said striker is operated in the striking manner or in the swinging manner, and a signal generator for generating a musical sound initiating command signal each time said switching means performs a switching action;

a musical sound generating means for generating a musical sound with a preset timbre each time the musical sound initiating command signal is generated from said sound-initiating command signal generating means; and timbre-selecting means for selecting a timbre of a musical sound to be generated from said musical sound generating means in accordance with the musical sound initiating command signal when the striker is operated in the striking manner or swinging manner, wherein said timbre-selecting means is provided in said musical sound generating means.

8. The electronic percussion instrument according to claim 7, wherein said switching means includes a pair of conductive members and an insulating member for insulating said pair of conductive members are spaced apart with each other while said striker is not operated in the striking manner or swinging manner, and the pair of conductive members are contacted with each other when said striker is operated in the striking manner or swinging manner, whereby the switching action of said switching means is performed to generate musical sound initiating command signals in response to the switching action.

9. An electronic percussion instrument, comprising:

a stick-shaped striker which is operated in a striking manner or a swinging manner;

normally open switching means, provided in said striker, for performing switching actions each time said striker is operated in the striking manner or in the swinging manner;

a signal generating means for generating a musical sound initiating command signal each time said normally open switching means performs a switching action;

a musical sound generating means for generating a single musical sound each time the musical sound initiating command signal is generated by said signal generating means; and signal-transmitting means for transmitting said musical sound initiating command signal to said musical sound generating means each time said musical sound initating command signal is generated from said signal generating means, wherein said normally open switching means comprises:

an undeflectable conductive member having a free end portion and a base end portion fitted in said striker;

an insulating member fitted on an outer surface of said base end portion of the undeflectable conductive member; and a deflectable conductive member, having a free end portion and a base end portion, which is so arranged that its base end portion is fitted on an outer surface of said insulating member and its free end portion (a) is separated from the free end portion of said undeflectable member by said insulating member when said striker is not operated in the striking manner or swinging manner, and (b) comes into electrical contact with the free end portion of said undeflectable conductive member by deflecting in accordance with vibration of said striker when the striker is operated in the striking manner or swinging manner.

10. The electronic percussion instrument according to claim 9, wherein said undeflectable conductive member is an elongated rigid conductive member arranged within the striker, in alignment with its longitudinal axis.

11. The electronic percussion instrument according to claim 9, wherein said deflectable conductive member is made from a helically wound conductive spring.

12. The electronic percussion instrument according to claim 9, wherein said deflectable conductive member is made from an elastic and cylindrical conductive tube.

13. The electronic percussion instrument according to claim 9, wherein said deflectable conductive member is a conductive coil spring.

14. The electronic percussion instrument according to claim 9, wherein said signal-transmitting means comprises a cord electrically connected to said signal generating means, at one end, and to said musical sound generating means, at the other end.

15. An electronic percussion instrument according to claim 9, wherein said signal-transmitting means comprises:

a radio wave transmitter, provided in said striker, having means for transmitting a predetermined radio wave in response to a musical sound initiating command signal from said signal generating means; and a radio wave receiver, provided within said musical sound generating means, having means for receiving the radio wave transmitted from said radio wave transmitter and to indicate initiation of generation of a musical sound in response to said received radio wave.

* * * * *

UNITED STATES PATENT AND TRADEMARK OFFICE

CERTIFICATE OF CORRECTION

PATENT NO. : 5,157,213

DATED : October 20, 1992

INVENTOR(S) : KASHIO et al

It is certified that error appears in the above-identified patent and that said Letters Patent is hereby corrected as shown below:

Column 2, line 45, change "swing" to --swung--.

Column 7, line 50, change "timbre-shift" to --timbre-selecting--.

Column 7, line 53, change "timbre-shift" to --timbre-selecting--.

Column 13, line 27, delete "the" (second occurrence).

Column 13, line 53, change "shift" to --selecting--.

Column 14, line 39, before "struck", insert --is--.

Column 15, line 63, change "RSF/Fs" to --RS F/Fs--.

Column 14, line 38, delete "is".

Signed and Sealed this

Twenty-ninth Day of March, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,157,213
DATED : October 20, 1992
INVENTOR(S) : Kashio, et. al.

It is certified that error appears in the above-indentified patent and that said Letters Patent is hereby corrected as shown below:

Title page, item [30], under Foreign Appliction Priority Data:

Change "98967(U)" to --61-98967(U)--;

Change "104238(U)" to --61-104238(U)--; and

Change "138883(U)" to --61-138883(U)--.

Signed and Sealed this

Twenty-second Day of November, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,157,213
DATED : October 20, 1992
INVENTOR(S) : KASHIO et al

It is certified that error appears in the above-indentified patent and that said Letters Patent is hereby corrected as shown below:

Column 2, line 45, change "swing" to --swung--.

Column 7, line 50, change "timbre-shift" to --timbre-selecting--.

Column 7, line 53, change "timbre-shift" to --timbre-selecting--.

Column 13, line 27, delete "the" (second occurrence).

Column 13, line 53, change "shift" to --selecting--.

Column 14, line 37, delete "is".

Column 14, line 38, before "struck", insert --is--.

Column 15, line 63, change "RSF/Fs" to --RS F/Fs--.

This certificate supersedes Certificate of Correction issued March 29, 1994.

Signed and Sealed this

Seventeenth Day of January, 1995

*Attest:*

*Attesting Officer*

BRUCE LEHMAN

*Commissioner of Patents and Trademarks*